US010590947B2

(12) United States Patent
Niu et al.

(10) Patent No.: US 10,590,947 B2
(45) Date of Patent: Mar. 17, 2020

(54) IMPELLER, CENTRIFUGAL PUMP AND ELECTRIC PUMP

(71) Applicant: Hangzhou Sanhua Research Institute Co., Ltd., Hangzhou, Zhejiang (CN)

(72) Inventors: Lianjing Niu, Zhejiang (CN); Chen Fang, Zhejiang (CN); Ri Zhou, Zhejiang (CN); Junfeng Bao, Zhejiang (CN)

(73) Assignee: Zhejiang Sanhua Automotive Components Co., Ltd., Hangzhou, Zhejiang (CN)

( * ) Notice: Subject to any disclaimer, the term of this patent is extended or adjusted under 35 U.S.C. 154(b) by 164 days.

(21) Appl. No.: 15/270,459

(22) Filed: Sep. 20, 2016

(65) Prior Publication Data

US 2017/0089355 A1 Mar. 30, 2017

(30) Foreign Application Priority Data

Sep. 30, 2015 (CN) ..... 2015 1 0640072

(51) Int. Cl.
*F04D 29/24* (2006.01)
*F04D 13/06* (2006.01)
(Continued)

(52) U.S. Cl.
CPC ..... *F04D 29/242* (2013.01); *F04D 13/0606* (2013.01); *F04D 29/2216* (2013.01); *F04D 29/2255* (2013.01); *F04D 29/30* (2013.01)

(58) Field of Classification Search
CPC .. F04D 29/242; F04D 29/026; F04D 29/2255; F04D 29/2272; F04D 29/24;
(Continued)

(56) References Cited

U.S. PATENT DOCUMENTS 2,165,808 A * 7/1939 Murphy ..... F04D 29/242 415/208.1
2,266,180 A 12/1941 Emerick
(Continued)

FOREIGN PATENT DOCUMENTS

DE 20 2015 102 491 U1 10/2015

OTHER PUBLICATIONS

Extended European Search Report for Application No. EP16189563.6, dated Feb. 22, 2017.

*Primary Examiner* — Kenneth J Hansen
(74) *Attorney, Agent, or Firm* — Wolf, Greenfield & Sacks, P.C.

(57) ABSTRACT

An impeller is provided, which includes an upper plate, blades, and a lower plate. The blades are arranged between the upper plate and lower plate. The upper plate includes an upper surface and a lower surface, the blades are integrally formed with the upper plate by injection molding, and the blades are located at the lower surface of the upper plate. The blades include first blades. Each of the first blades includes one arc, a combination of multiple arcs, or a combination of multiple arcs and straight lines. The first blades are uniformly distributed along a circumference of the upper plate, and the first blade includes a first tail, and the first tail of the first blade make a first side of the first blade have no intersection with an outer edge of the upper plate.

16 Claims, 16 Drawing Sheets

(51) Int. Cl.
*F04D 29/22* (2006.01)
*F04D 29/30* (2006.01)

(58) Field of Classification Search
CPC ..... F04D 29/2277; F04D 29/282; F04D 29/2211; F04D 29/2216; F04D 29/225; F04D 29/2238; F04D 13/0606
See application file for complete search history.

(56) References Cited

U.S. PATENT DOCUMENTS

| | | | | |
|---|---|---|---|---|
| 5,368,443 | A * | 11/1994 | Turkia | F04D 29/2216 416/183 |
| 5,545,008 | A | 8/1996 | Guelich | |
| 2007/0065316 | A1* | 3/2007 | Hanke | F04D 29/426 417/423.7 |
| 2015/0337665 | A1 | 11/2015 | Yang | |

* cited by examiner

IMPELLER, CENTRIFUGAL PUMP AND ELECTRIC PUMP

CROSS-REFERENCE TO RELATED APPLICATIONS

The present application claims the benefit of priority to Chinese patent application No. 201510640072.7 titled "IMPELLER, CENTRIFUGAL PUMP AND ELECTRIC PUMP", filed with the Chinese State Intellectual Property Office on Sep. 30, 2015, the entire disclosure of which is incorporated herein by reference.

FIELD

This application relates to heat circulation systems, and particularly to a centrifugal pump having an impeller.

BACKGROUND

In recent decades, a centrifugal pump, especially an electric pump, has been widely used in a heat circulation system. Currently, the heat circulation system is developed towards high performance and compactification. Accordingly, a mounting space for the electric pump is limited, and further, the pump is required to have a small overall dimension and a small volume. The impeller employed in the pump correspondingly has a small diameter so as to ensure the pump to have a small overall dimension and a small volume. In this case, an impeller of a conventional pump can hardly meet the high lift requirement when the pump employs the impeller during a low flow-rate situation.

Therefore, it is necessary to improve the conventional technology so as to address the above technical issues.

SUMMARY

An object of the present application is to provide an impeller, which improves lift of a pump when the pump employs the impeller during a low flow-rate situation.

A technical solution is adopted according to the present application. An impeller includes an upper plate, blades, and a lower plate. The blades are arranged between the upper plate and lower plate, and the upper plate includes an upper surface and a lower surface. The blades are integrally formed with the upper plate by injection molding, and the blades are fixedly connected to the lower surface of the upper plate. The blades include first blades. In a direction from the lower surface to the upper surface of the upper plate along an axis of the impeller, each of the first blades includes one arc, a combination of one arc and one straight line, a combination of more than two arcs, or a combination of more than two arcs and straight lines. The first blades are uniformly distributed along the circumference of the upper plate. Each of the first blades includes a first side, a second side, a first head and a first tail. The first head is closer to a central portion of the impeller than the first tail. The first side is a concave face, and the second side is a convex face. A connecting portion between the first tail and the second side is arranged close to an outer edge of the upper plate or flush with the outer edge of the upper plate. The outer edge of the upper plate is a first circumference. The diameter of the first circumference is a first diameter. The first side has no intersection with the outer edge of the upper plate. The distance of a connecting portion between the first tail and the first side from the outer edge of the upper plate is greater than the distance of the connecting portion between the first tail and the second side from the outer edge of the upper plate.

A centrifugal pump is further provided according to the present application, which includes an impeller including the impeller described above.

An electric pump is further provided according to the present application, which includes a shaft, a rotor assembly and a stator assembly. The rotor assembly includes an impeller and a rotor. The rotor includes a permanent magnet, and the permanent is arranged closer to the shaft than the stator assembly. The impeller includes the impeller described above.

Compared with the conventional technology, in the present application, the first impeller is provided with the first tail such that the concave face of the first blade has no intersection with the outer edge of the upper plate, which facilitates restricting a tail flow of the first blade and improving the lift of the pump employing the impeller.

DETAILED DESCRIPTION

The present application is further described with reference to the drawings and embodiments.

Figure 1:
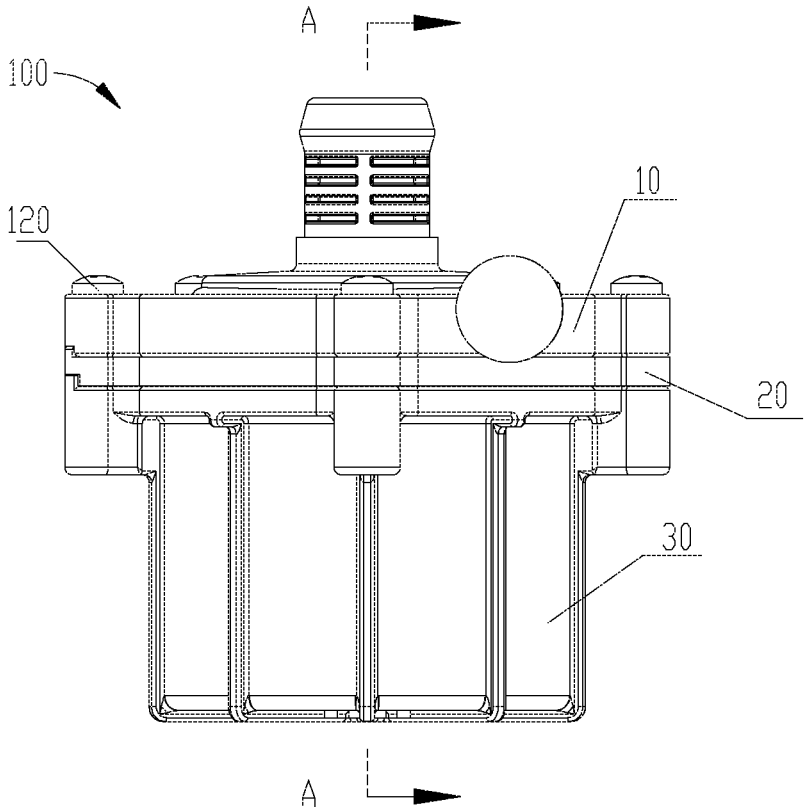
FIG. 1 is a schematic view showing the structure of an embodiment of an electric pump according to the present application.
Figure 2:
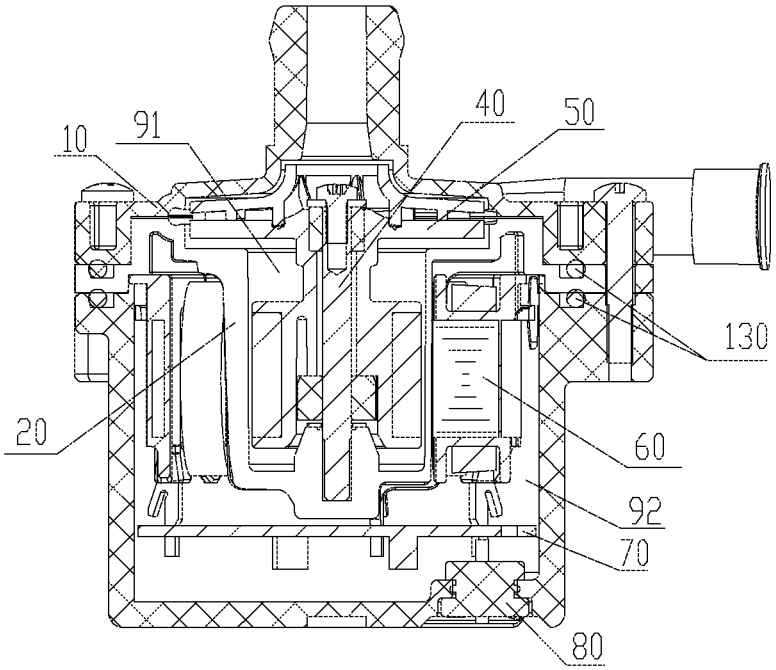
FIG. 2 is a schematic sectional view showing the structure of the electric pump in FIG. 1 taken along line A-A.
Figure 3:
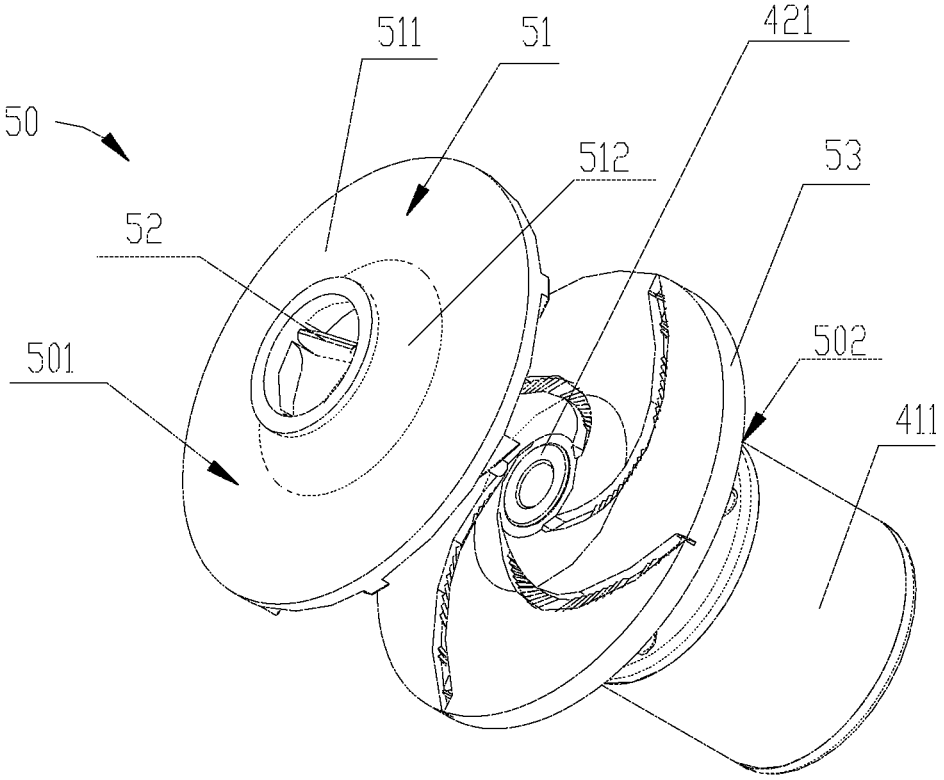
FIG. 3 is a schematic exploded view showing the structure of an embodiment of a rotor assembly in FIG. 2.
Figure 4:
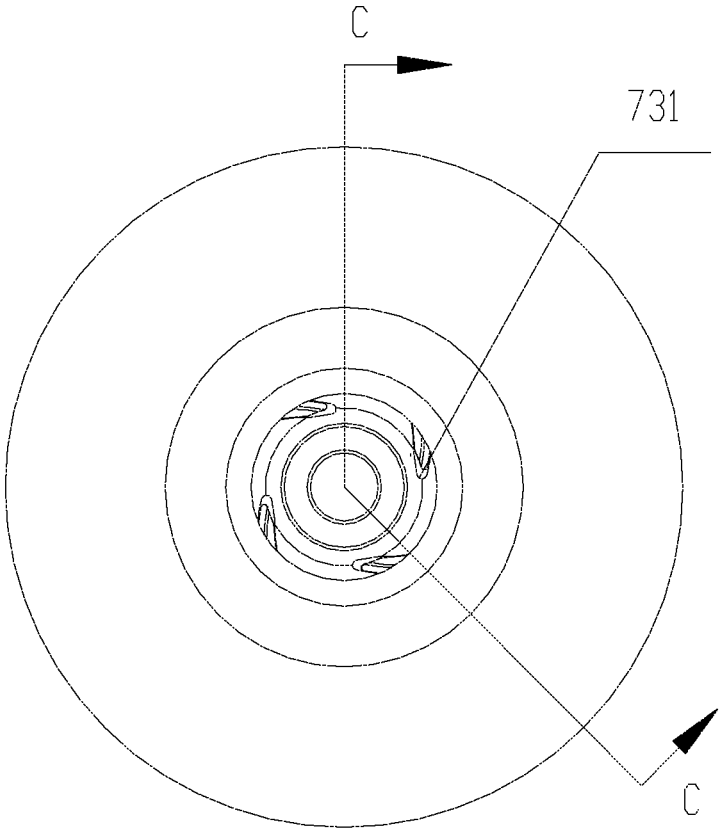
FIG. 4 is a schematic top view showing the structure of an embodiment of the rotor assembly in FIG. 2.

FIG. 1 is a schematic view showing the structure of an embodiment of an electric pump 100. The electric pump 100 includes a housing, and the housing forms a pump chamber. In this embodiment, the housing includes a first housing 10, a partition 20 and a second housing 30. In this embodiment, the first housing 10, the partition 20 and the second housing 30 are injection-molded, respectively. The first housing 10 is fixed to the partition 20 by a screw 120 or a bolt, and the partition 20 is fixed to the second housing 30 by a screw 120 or a bolt. A sealing ring 130 is provided at a connecting portion between the first housing 10 and the partition 20 and a connecting portion between the partition 20 and the second housing 30 (referring to FIG. 2), which may improve the airtightness of the connecting portions. Referring to FIG. 2, the partition 20 divides the pump chamber into a wet chamber 91 and a dry chamber 92. A working medium may flow through the wet chamber 91, and no working medium flows through the dry chamber 92. Apparently, the housing may also be other structures. The structure of the housing adopted in this embodiment has a relative simple manufacturing process, and the parts and components of the electric pump are convenient to be assembled. The electric pump 100 in this embodiment is mainly used in a heat circulation system, and the heat circulation system includes a cooling circulation system and/or a heating circulation system, and the electric pump 100 is mainly to provide circulating power to the working medium. The electric pump 100 in this embodiment may be applied in a vehicle cooling circulation system. The electric pump 100 in this embodiment is a pump having a low rate and a high lift.

Referring to FIG. 2, the electric pump 100 further includes a shaft 40, a rotor assembly 50, a stator assembly 60, a circuit board 70, and a connecting assembly 80. The rotor assembly 50 is arranged in the wet chamber 91, and the stator assembly 60 and the circuit board 70 are arranged in the dry chamber 92. The shaft 40 and the partition 20 are fixed to each other by injection molding, and the rotor assembly 50 rotates about the shaft 40. The rotor assembly 50 includes an impeller 5 and a rotor 4, and the rotor 4 includes a permanent magnet. The rotor assembly 50 is partitioned from the stator assembly 60 by the partition 20, and the stator assembly 60 is electrically connected to the circuit board 70. In this embodiment, the electric pump 100 is an internal rotor type electric pump, and the internal rotor type electric pump refers a pump in which the permanent magnet of the rotor assembly 50 is arranged to be closer to the shaft 40 than the stator assembly 60 when taking the shaft 40 as a central shaft.

Figure 5:
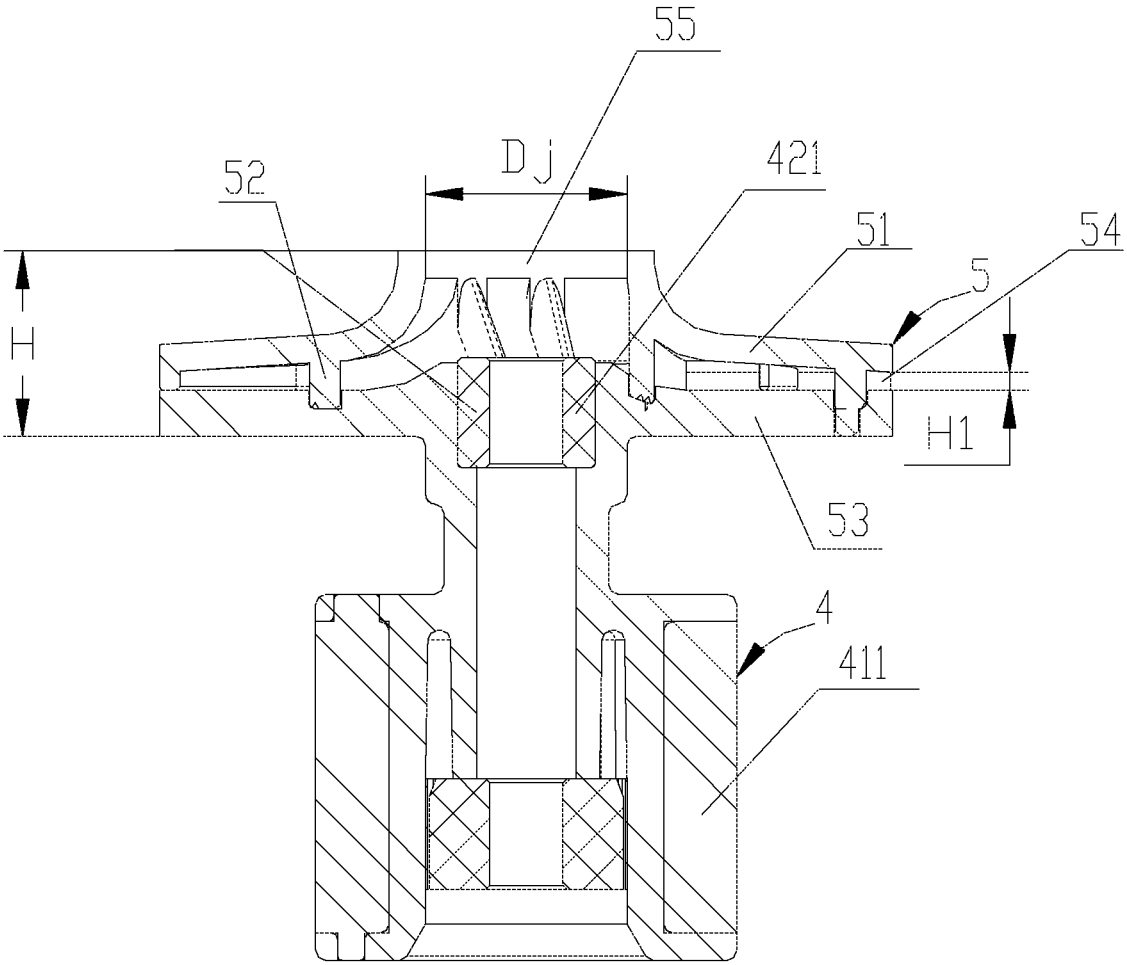
FIG. 5 is a schematic sectional view showing the structure of the rotor assembly in FIG. 4 taken along line C-C.
Figure 6:
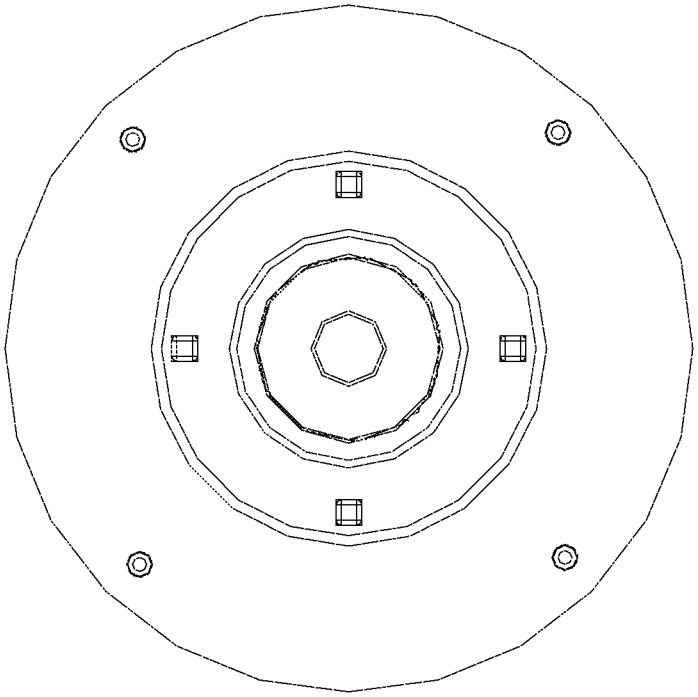
FIG. 6 is a schematic bottom view showing the structure of an embodiment of the rotor assembly in FIG. 2.

Referring to FIGS. 2 to 7, the rotor assembly 50 includes two parts of injection molded pieces: a first part 501 and a second part 502, and the first part 501 is fixed to the second part 502 by, for example, ultrasonic welding. The first part 501 includes an upper plate 51 and blades 52, and the first part 501 is integrally formed by injection molding. The material of the first part 501 is a mixture of polyphenylene sulfide plastic (abbreviated as PPS plastic) and glass fibers, and the material of the first part 501 may also be other thermoplastic materials having a good mechanical performance. The second part 502 includes a permanent magnet 411, a first bearing 421 and a lower plate 53. The second part 502 includes an injection molded piece formed by using the permanent magnet 411 as an injection molding insert for injection molding a mixed material containing the PPS plastic and carbon fibers, and the material of the second part 502 may also be other thermoplastic materials having a good mechanical performance. Referring to FIG. 5, the rotor assembly 50 functionally includes the impeller 5 and the rotor 4. The impeller 5 includes the upper plate 51, the blades 52 and the lower plate 53, and the rotor 4 includes the permanent magnet 411. In this embodiment, the lower plate 53 and the permanent magnet 411 are integrally formed by injection molding, and the impeller 5 may also be separately formed and is not limited to being formed integrally with the rotor 4.

Referring to FIGS. 2 to 7, the impeller 5 includes an inlet 55, the upper plate 51, the blades 52, and the lower plate 53, an outlet 54. The blades 52 are arranged between the upper plate 51 and the lower plate 53. The upper plate 51 forms the inlet 55. The outlet 54 is arranged to be close to an outer edge of the impeller 5. The outlet 54 is formed between the upper plate 51 and the lower plate 53 and between adjacent blades 52. Multiple flow passages are formed between adjacent blades 52, and each of the flow passages connects the inlet 55 and one of the outlets 54. In this embodiment, the distance from a top end of the upper plate 51 which forms the inlet 55 to a lower surface of the lower plate 53 is a height H of the impeller 5. When the electric pump operates, the working medium enters from the inlet 55 and rotates along with the impeller 5, thus the working medium pressure is increased, and then the working medium leaves the impeller 5 through the outlets 54.

Referring to FIGS. 3 to 7, the upper plate 51 substantially is in an annular shape, the upper plate 51 includes a plane portion 511 and a curved portion 512, and the plane portion 511 and the curved portion 512 are connected and transited smoothly. The curved portion 512 forms the inlet 55, and defines an inlet diameter Dj which is the diameter of the inlet 55. An outer edge of the upper plate 11 is defined substantially as a first circumference, and the diameter of the first circumference is a first diameter Φ1, and the diameter of the impeller 5 is substantially equal to the first diameter Φ1. In this embodiment, the ratio of the first diameter Φ1 to the inlet diameter Dj ranges from 2 to 8.75. Arranged in this way, facilitates improving lift of the electric pump that employs the impeller.

The blades 52 include first blades 521 and second blades 522. In a direction from a lower surface to an upper surface of the upper plate 51 along an axis of the impeller 5, each of the first blades 521 and the second blades 522 may be a cambered surface, a combination of two or more cambered surface s, or a combination of a cambered surface and a plane. The length of each of the first blades 521 is greater than the length of each of the second blades 522. The first blades 521 are distributed at equal intervals along the circumference of the impeller 5. The second blades 522 are distributed at equal intervals along the circumference of the impeller 5. The number of the first blades 521 is equal to the number of the second blades 522. In this embodiment, the number of the first blades 521 and the number of the second blades 522 are both four. The first blades 521 and the second blades 522 are distributed at intervals along the circumference of the impeller 5. That is, each of the second blades 522 is arranged between two first blades 521 adjacent to each other. The first blade 521 includes a first head 731, a first side 733, a second side 744, and a first tail. The first side 733 is a concave, and the second side 744 is a convex. The thickness ε of the first blade refers to a vertical distance between the first side 733 and the second side 744. The first head 731 is arranged to extend into the inlet 55, and the first tail is arranged to allow the first side 733 to have no intersection with the outer edge of the upper plate 51. The first tail can change a trend of the working medium at an end of the first side 733, and facilitate improving lift of the electric pump that employs the impeller 5. The second blade 522 includes a second head 5223 and a second tail 5224, and the second head 5223 is located on a second circumference. The diameter of the second circumference is a second diameter Φ2, and the ratio of the second diameter Φ2 to the first diameter Φ1 ranges from 0.6 to 0.8. The second tail 5224 is arranged flush with the edge of the upper plate 51. Each of the second blades 522 further includes a third side 5221 and a fourth side 5222, and the third side 5221 is a concave, and the fourth side 5222 is a convex.

In the direction from the lower surface to the upper surface of the upper plate 51 along the axis of the impeller 5, on the first circumference, an arc between intersections of second sides 744 of adjacent first blades 521 or extending lines of the second sides 744 of adjacent first blades 521 with the first circumference is a first arc. The arc length of the first arc is a first arc length L1, and the first arc length L1 is equal to the length of the arc obtained by dividing the first circumference equally by the number of the first blades 521. In this embodiment, the number of the first blades 521 is four. The first arc length L1 is equal to the arc length obtained by dividing the perimeter of the first circumference into four equal parts. The second side 744 substantially reaches the position of the first circumference or is closer to the position of the first circumference than the first side 733. On the first circumference, a arc between a second side 744 or an extending line of the second side 744 and a fourth side 5224 or an extending line of the fourth side 5224 of the second blade 522 closer to the first side 733 is a second arc. The arc length of the second arc is a second arc length L2. The second arc length L2 is 0.35 to 0.45 times of the first arc length L1. The second blade 522 arranged as such is arranged close to the first side 733 of the first blade 521, which facilitates change a trend of the working medium between the first side face 733, and improving lift of the electric pump that employs the impeller 5.

On the first circumference, at an intersection of the second side 744 of the first blade 521 or the extending line of the second side 744 of the first blade 521 with the first circumference, an included angle between a tangency of the second side 744 and a tangency of the first circumference at the intersection is a first included angle β1 of the first blade 521, and the first included angle β1 ranges from 30 degrees to 50 degrees. In this embodiment, the first included angle β1 can reduce the friction loss, thereby ensuring a high efficient operation of the electric pump. For acquiring a stable performance curve and preventing an overload phenomenon, and for the structure of the impeller 5 according to this embodiment, the first included angle β1 according to the present application ranges from 30 degrees to 50 degrees.

In this embodiment, on the first circumference, the distance from the lower surface of the upper plate 51 to an upper surface of the lower plate 53 is an outlet height H1 of the impeller 5. In this embodiment, the outlet height H1 of the impeller 5 ranges from 0.5 mm to 1.5 mm, in this way, an axial dimension of the impeller and a smooth flowing of the working medium may be ensured.

Figure 7:
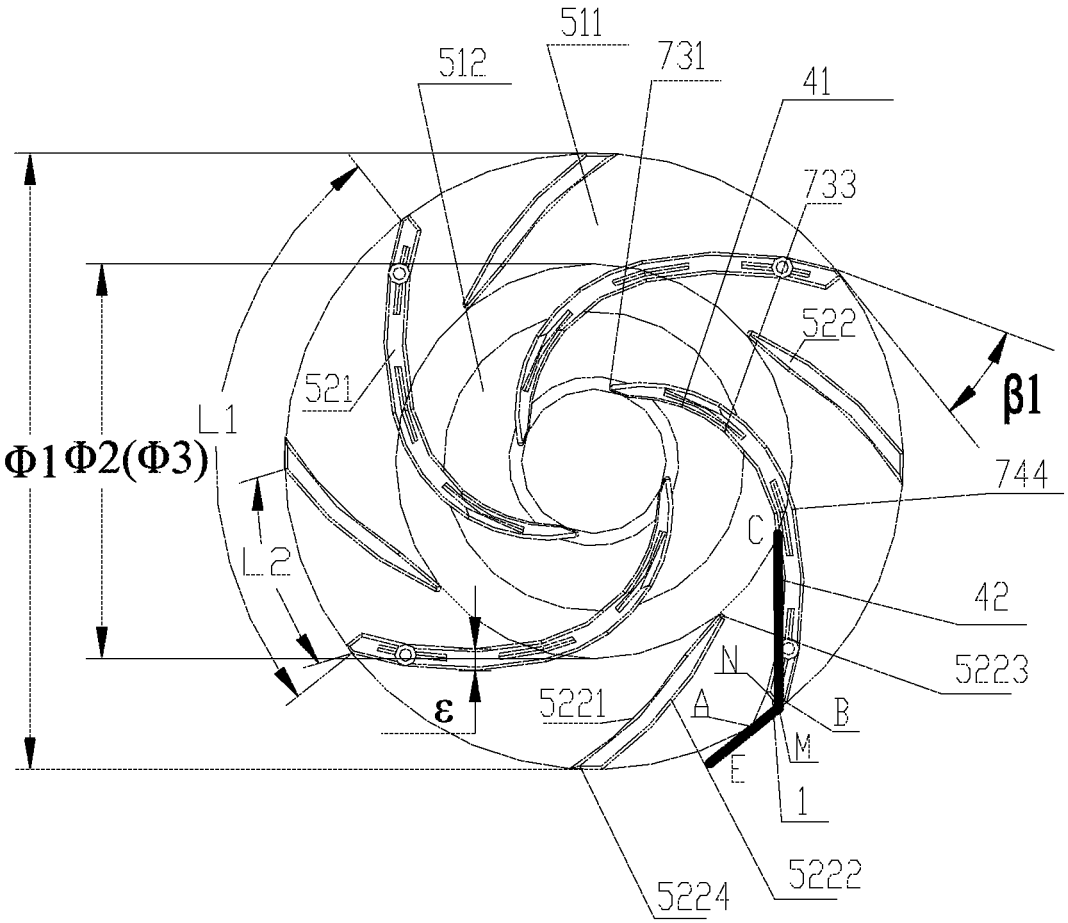
FIG. 7 is a schematic view showing the structure of a first embodiment of a first part of the rotor assembly in FIG. 3.

FIG. 7 is a schematic front view showing the structure of a first embodiment of the first part. That is, in the direction from the lower surface to the upper surface of the upper plate along the axis of the impeller 5, the first blade 521 includes the first side 733, the second side 744, the first head 731, and a first tail 1. The first tail 1 includes a first point M and a second point N. Here, the first side 733 has a certain distance from the outer edge of the upper plate 51. An intersection of an extending line of the first side 733 with the outer edge of the upper plate 51 is defined as a first intersection A, and an intersection of the extending line of the second side 744 or the second side 744 with the outer edge of the upper plate is defined as a second intersection B. The distance of a connecting portion between the first tail 1 and the first side 733 from the outer edge of the upper plate 51 is greater than the distance of a connecting portion between the first tail 1 and the second side 744 from the outer edge of the upper plate 51. In this embodiment, in the direction from the lower surface to the upper surface of the upper plate along the axis of the impeller 5, the first side 733 includes a first arc 41 and a second arc 42. The curvature of the first arc 41 is greater than the curvature of the second arc 42. The first side 733 includes a connecting point C, and the first arc 41 and the second arc 42 are connected tangentially or transited smoothly at the connecting point C. A third circumference is defined, and the diameter of the third circumference is a third diameter Φ3, and the connecting point C is located on the third circumference. A ratio of the third diameter Φ3 to the first diameter Φ1 ranges from 0.5 to 0.8. The first tail 1 includes an inclined portion, and the projection of the inclined portion to the upper plate 51 is a line. The inclined portion includes a first point M and a second point N, and the first point M is located between the first intersection A and the second intersection B of the first circumference, or is arranged close to an arc between the first intersection A and the second intersection B of the first circumference, that is, the first point M may be located at a position on the first circumference or is located at a position within the first circumference but relatively close to the first circumference. The first point M is not coincident with the first intersection A. At the first point M, a first borderline ME which is part of a tangency of the first circumference is defined, and a second borderline MC which is a connecting line between the first point M and the connecting point C is defined. An included angle between the first borderline and the second borderline is greater the 90 degree. The second point N is located at the first side 733 or the shortest distance of the second point N from the first side 733 or from the extending line of the first side 733 is less than ⅓ of the thickness ϵ of the first blade 521. In the direction from the lower surface to the upper surface of the upper plate 51 along the axis of the impeller 5, the second point N is located in between the first borderline ME and the second borderline MC, and a connecting line of the first point M and the second point N is located between the first borderline ME and the second borderline MC. The first tail 1 arranged as such would not interfere with the second side 744, which forms a cutting portion to the first side 733, and facilitates reduce vortex, close to the outer edge of the upper plate 51, of the first side 733, thereby meeting the requirement of the system for the working medium.

Figure 8:
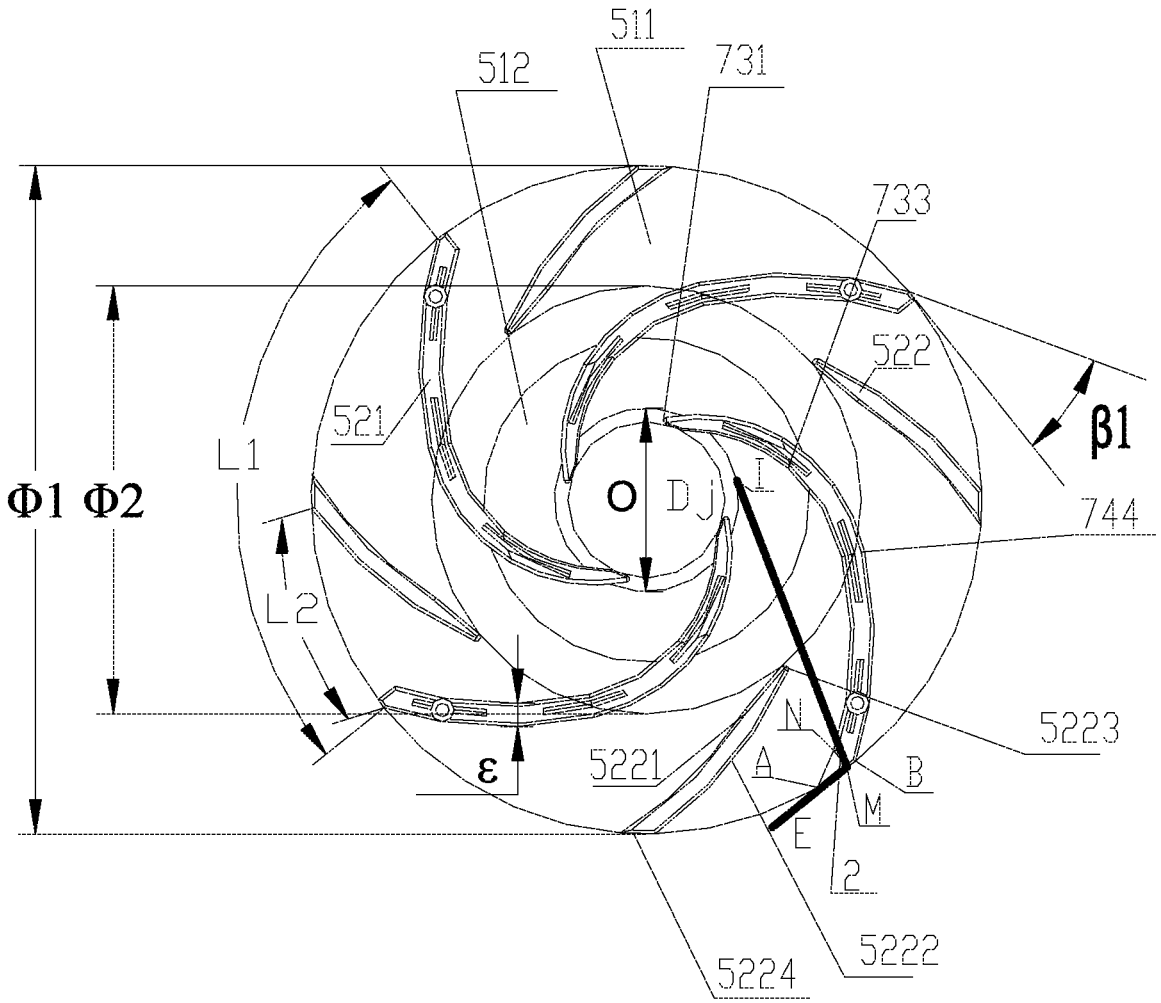
FIG. 8 is a schematic view showing the structure of a second embodiment of the first part of the rotor assembly in FIG. 3.

FIG. 8 is a schematic view showing the structure of a second embodiment of the first part. The first blade 521 includes a first tail 2. The first tail 2 includes a first point M and a second point N. In the direction from the lower surface to the upper surface of the upper plate 51 along the axis of the impeller 5, an intersection of the extending line of the first side 733 with the outer edge of the upper plate 51 is defined as a first intersection A, and an intersection of the extending line of the second side 744 or the second side 744 with the outer edge of the upper plate is defined as a second intersection B. The first point M is located at a position, between the first intersection A and the second intersection B, on the first circumference, or is arranged close to the arc between the first intersection A and the second intersection B of the first circumference. That is, the first point M may be located at a position on the first circumference or may be located at a position within the first circumference but relatively close to the first circumference. The first point M is not coincident with the first intersection A. At the first point M, a first borderline ME is defined, the first borderline ME is part of a tangency of the first circumference is made. The diameter of the inlet circumference is defined as an inlet diameter Dj, and a tangency is made at the first point M to a position, at a side close to the first side 733 of the first blade 521, of the inlet circumference as a second borderline MI, the second point N is located at the first side 733 or the shortest distance of the second point N from the first side 733 or from the extending line of the first side 733 is less than ⅓ of the thickness ϵ of the first blade 521, and the second point N is located at between the first borderline ME and the second borderline MI, and the connecting line of the first point M and the second point N is located at between the first borderline ME and the second borderline MI. An included angle between the first borderline and the second borderline is greater the 90 degree.

Figure 9:
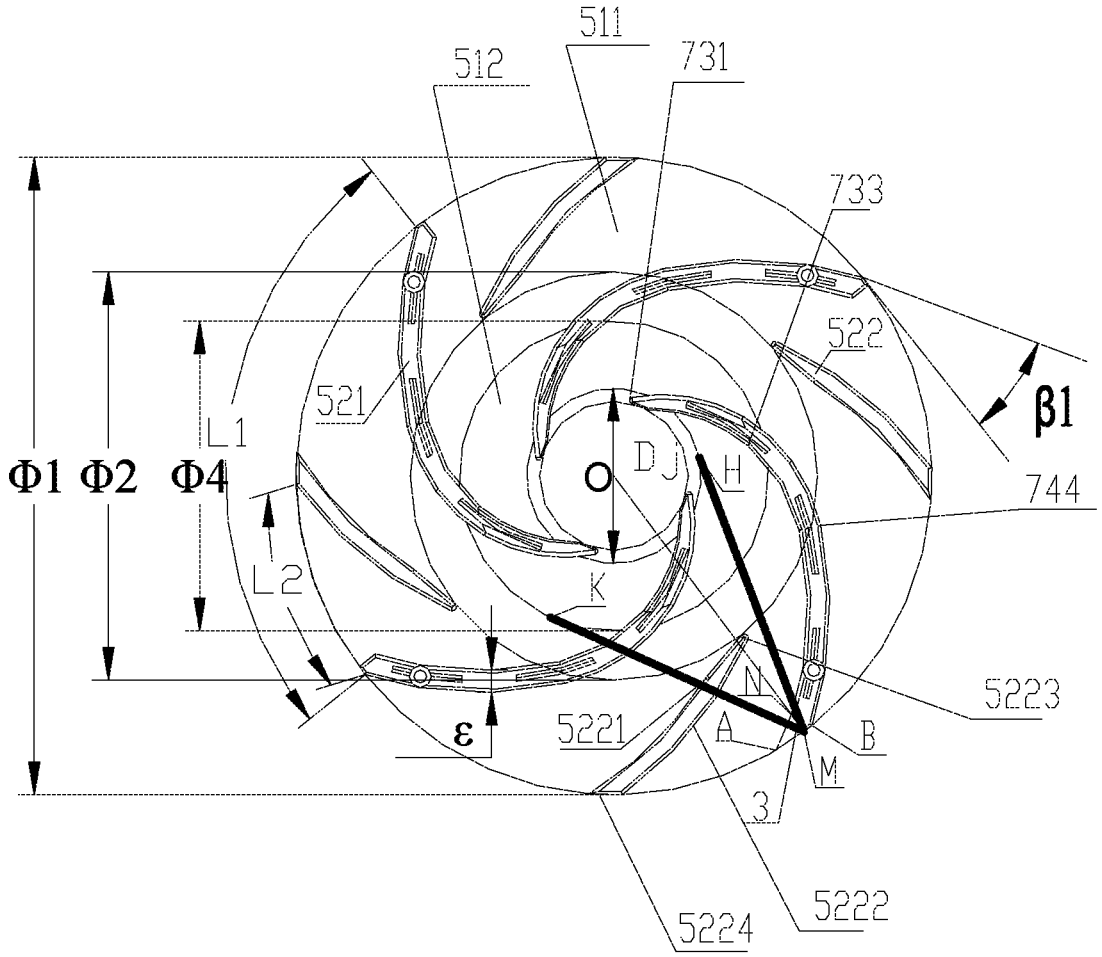
FIG. 9 is a schematic view showing the structure of a third embodiment of the first part of the rotor assembly in FIG. 3.

FIG. 9 is a schematic view of a third embodiment of the first part. The first blade 521 includes a first tail 3. The first tail 3 includes a first point M and a second point N. In the direction from the lower surface to the upper surface of the upper plate 51 along the axis of the impeller 5, an intersection of the extending line of the first side 733 with the outer edge of the upper plate 51 is a first intersection A, and an intersection of the extending line of the second side 744 or the second side 744 with the outer edge of the upper plate 51 is a second intersection B. The first point M is located at between the first intersection A and the second intersection B, on the first circumference, or is arranged at a position close to a position, between the first intersection A and the second intersection B, of the first circumference. That is, the first point M may be located on the first circumference or may be located at a position within the first circumference but relatively close to the first circumference. The first point M is not coincident with the first intersection A. A fourth circumference is defined with an impeller center O of the impeller being a center and half of the first diameter being a diameter, i.e., the diameter of the fourth circumference is defined as a fourth diameter Φ4, the fourth diameter is ½ Φ1. A tangency is made at the first point M to a position, at a side away from the first side 733 of the first blade 521, of the fourth circumference as a first borderline MK. A tangency is made at the first point M to a position, at a side close to the first side 733 of the first blade 521, of the inlet circumference as a second borderline MH. The second point N is located at the first side 733 or the shortest distance of the second point N from the first side 733 or from the extending line of the first side 733 is less than ⅓ of the thickness ϵ of the blade, and is located between the first borderline MK and the second borderline MH. The connecting line of the first point M and the second point N is located between the first borderline MK and the second borderline MH.

Figure 10:
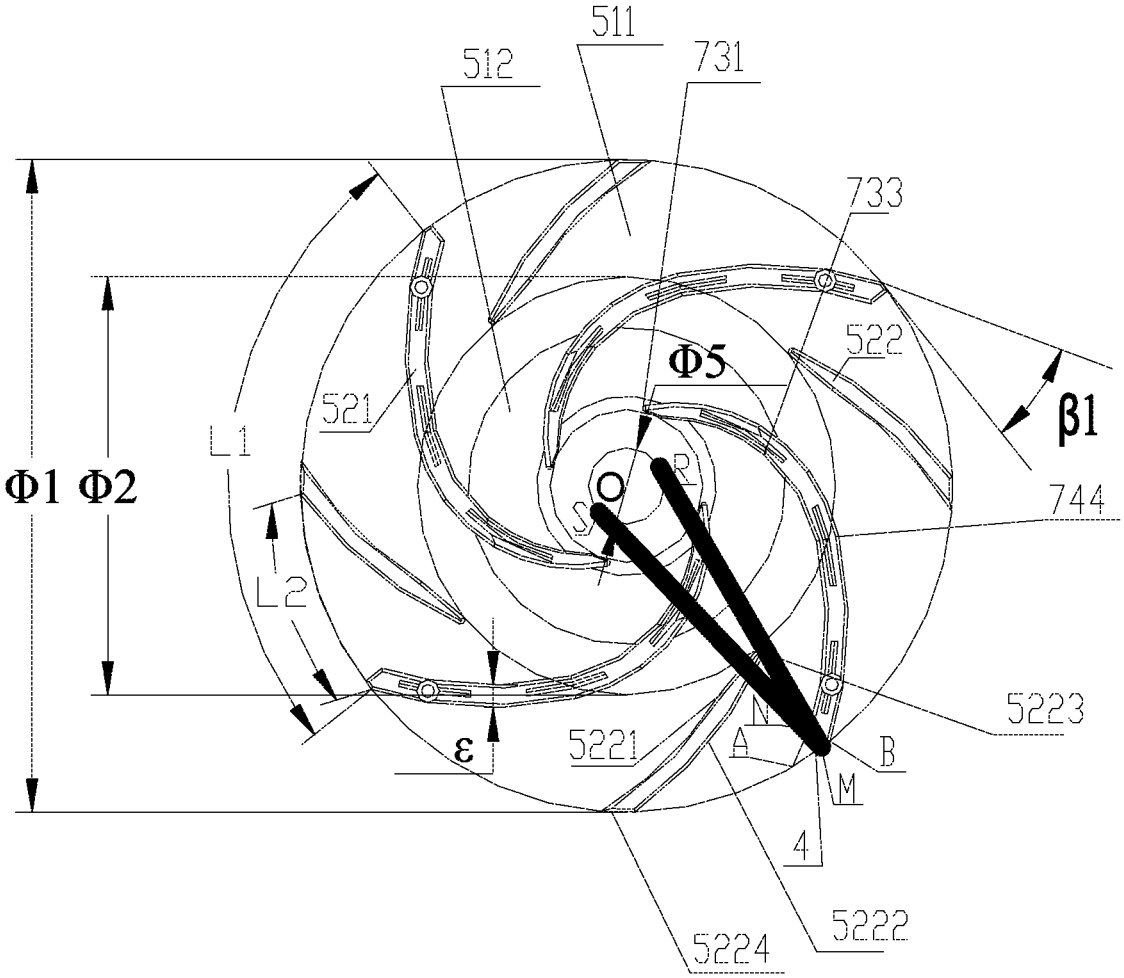
FIG. 10 is a schematic view showing the structure of a fourth embodiment of the first part of the rotor assembly in FIG. 3.

FIG. 10 is a schematic view of a fourth embodiment of the first part. The first blade 521 includes a first tail 4. The first tail 4 includes a first point M and a second point N. In the direction from the lower surface to the upper surface of the upper plate 51 along the axis of the impeller 5, the first point M is located at the second side 744 or close to the second side 744, and the second point N is located at the first side 733 or close to the first side 733. The distance of the second point N from the first circumference is greater than the distance of the first point M from the first circumference. A fifth circumference is defined with the impeller center O of the impeller 5 as a center and half of the inlet diameter of the inlet circumference as a diameter. The diameter of the fifth circumference is defined as a fifth diameter Φ5. An intersection of the extending line of the first side 733 with the outer edge of the upper plate 51 is a first intersection A, and an intersection of the extending line of the second side 744 or the second side 744 with the outer edge of the upper plate is a second intersection B. The first point M is located at a position, between the first intersection A and the second intersection B, on the first circumference, or is arranged at a position close to a position, between the first intersection A and the second intersection B, of the first circumference. That is, the first point M may be located on the first circumference or may be located at a position within the first circumference but relatively close to the first circumference. The first point M is not coincident with the first intersection A. A fifth borderline MR and a sixth borderline MS are defined, and the fifth borderline MR and a sixth borderline MS are made at the first point M tangent to the fifth circumference. In the direction from the lower surface to the upper surface of the upper plate 51 along the axis of the impeller 5, the second point N is located between the fifth borderline MR and the sixth borderline MS and is located at the first side 733, or the shortest distance of the second point N from the first side 733 or from the extending line of the first side 733 is less than ⅓ of the thickness ϵ of the first blade 521. The connecting line of the first point M and the second point N is located between the fifth borderline MR and the six borderline MS.

Figure 11:
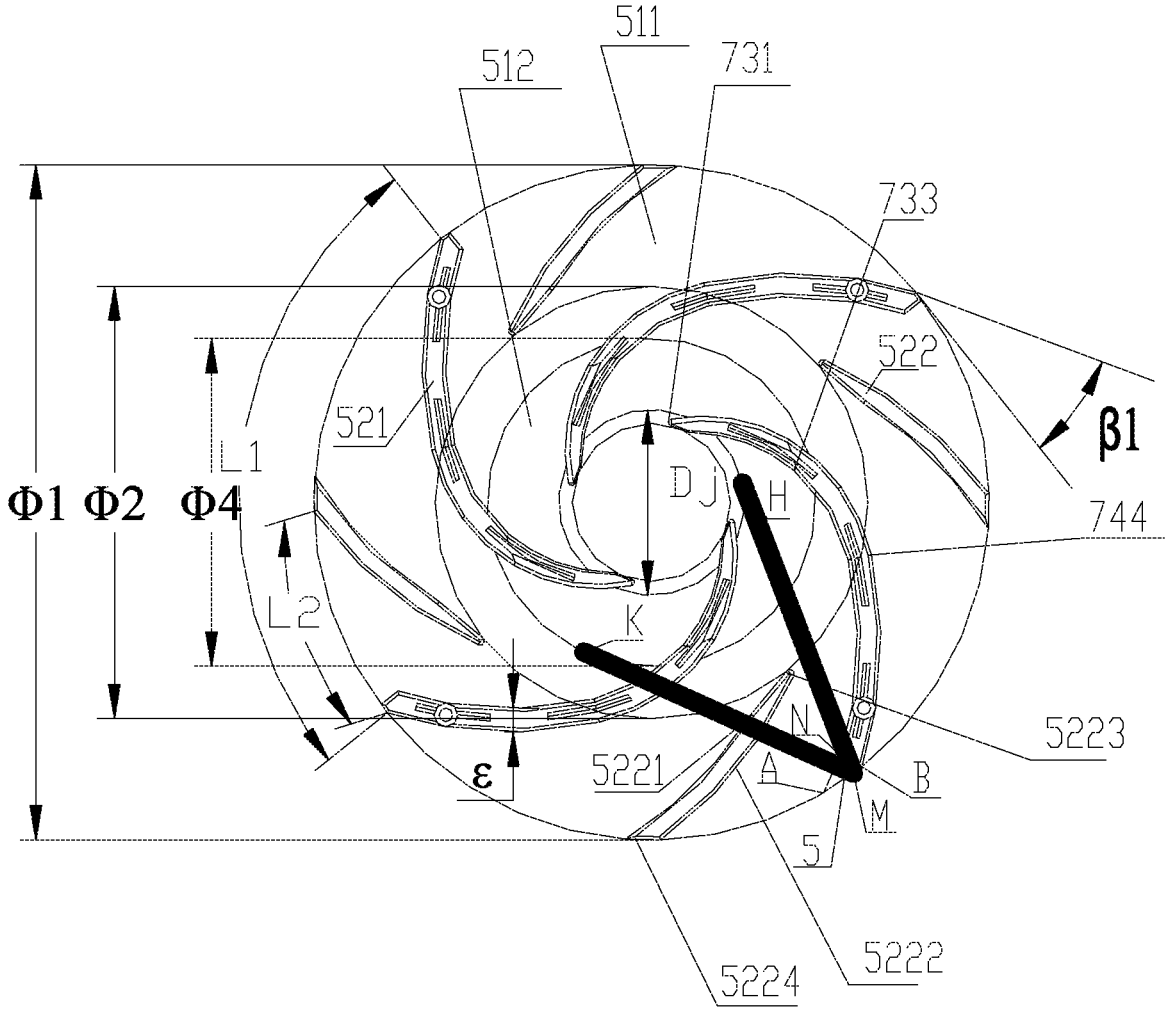
FIG. 11 is a schematic view showing the structure of a fifth embodiment of the first part of the rotor assembly in FIG. 3.

FIG. 11 is a schematic view of a fifth embodiment of the first part. The first blade 521 includes a first tail 5. The first tail 5 includes a first point M and a second point N. In the direction from the lower surface to the upper surface of the upper plate 51 along the axis of the impeller 5, an intersection of the extending line of the first side 733 with the outer edge of the upper plate 51 is defined as a first intersection A, and an intersection of the extending line of the second side 744 or the second side 744 with the outer edge of the upper plate 51 is defined as a second intersection B. The first point M is located at a position, between the first intersection A and the second intersection B, on the first circumference, or is arranged at a position close to a position, between the first intersection A and the second intersection B, of the first circumference. That is, the first point M may be located on the first circumference or may be located at a position within the first circumference but relatively close to the first circumference. In the case that the first point M is located on the first circumference, the arc length from the first point M to the first intersection A is greater than the arc length from the first point M to the second intersection B. In the case that the first point M is located within the first circumference and close to the first circumference, the distance from the first point M to the first intersection A is greater than the distance from the first point M to the second intersection B. A fourth circumference is defined with the impeller center O of the impeller as a center and half of the first diameter, i.e., the diameter of ½ Φ1, as a diameter, the diameter of the fourth circumference is a fourth diameter Φ4. A tangency is made at the first point M to a position, at a side away from the first side of the first blade, of the fourth circumference as a first borderline MK. A tangency is made at the first point M to a position, at a side close to the first side 733 of the first blade 521, of the inlet circumference as a second borderline MH. The second point N is located at the first side 733 or the shortest distance of the second point N from the first side 733 or from the extending line of the first side 733 is less than ⅓ of the thickness ϵ of the first blade 521, and is located between the first borderline MK and the second borderline MH. The connecting line of the first point M and the second point N is located between the first borderline MK and the second borderline MH.

Figure 12:
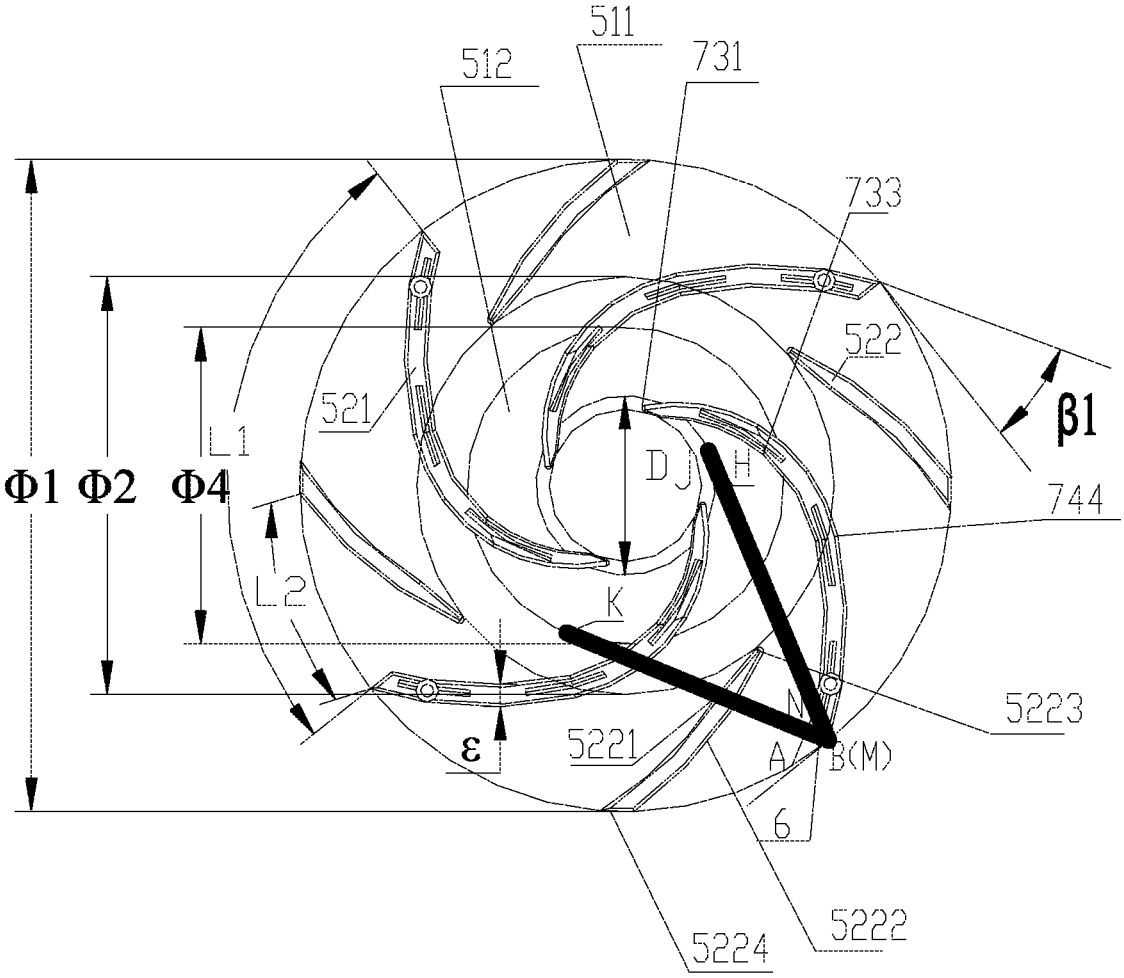
FIG. 12 is a schematic view showing the structure of a sixth embodiment of the first part of the rotor assembly in FIG. 3.

FIG. 12 is a schematic view of a sixth embodiment of the first part. In this embodiment, the first blade 521 includes a first tail 6. The first tail 6 includes a first point M and a second point N. In the direction from the lower surface to the upper surface of the upper plate 51 along the axis of the impeller 5, an intersection of the extending line of the first side 733 with the outer edge of the upper plate 51 is a first intersection A, and an intersection of the extending line of the second side 744 or the second side 744 with the outer edge of the upper plate 51 is a second intersection B. The first point M is arranged to be substantially coincident with the second intersection B. A fourth circumference is defined with the impeller center O of the impeller as a center and half of the first diameter, i.e., the diameter of ½ Φ1, as a diameter, the diameter of the fourth circumference is a fourth diameter Φ4. A tangency is made at the first point M to a position, at a side away from the first side 733 of the first blade 521, of the fourth circumference as a first borderline MK. A tangency is made at the first point M to a position, at a side close to the first side 733 of the first blade 521, of the inlet circumference as a second borderline MH. The second point N is located at the first side 733 or the shortest distance of the second point N from the first side 733 or from the extending line of the first side 733 is less than ⅓ of the thickness ϵ of the first blade 521, and is located between the first borderline MK and the second borderline MH. The connecting line of the first point M and the second point N is located between the first borderline MK and the second borderline MH.

Figure 13:
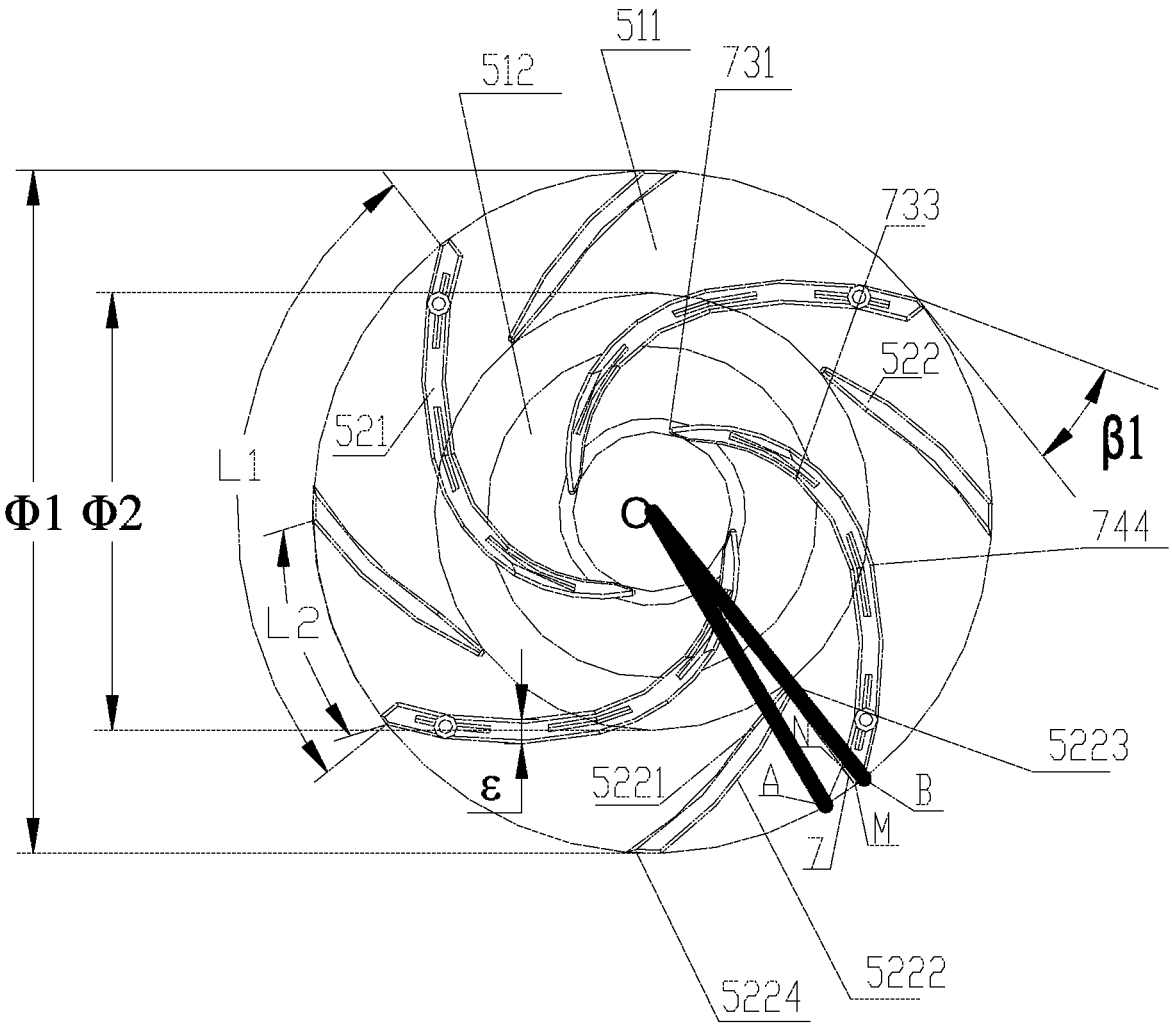
FIG. 13 is a schematic view showing the structure of a seventh embodiment of the first part of the rotor assembly in FIG. 3.

FIG. 13 is a schematic view of a seventh embodiment of the first part. In this embodiment, the first blade 521 includes a first tail 7. The first tail 7 includes a first point M and a second point N. In the direction from the lower surface to the upper surface of the upper plate 51 along the axis of the impeller 5, an intersection of the extending line of the first side 733 with the outer edge of the upper plate 51 is a first intersection A, and an intersection of the extending line of the second side 744 or the second side 744 with the outer edge of the upper plate 51 is a second intersection B. The first point M is located at a position, between the first intersection A and the second intersection B, on the first circumference, or is arranged at a position close to a position, between the first intersection A and the second intersection B, of the first circumference. That is, the first point M may be located on the first circumference or may be located at a position within the first circumference but relatively close to the first circumference. The distance from the first point M to the first intersection A is greater than the distance from the first point M to the second intersection B. The second point N is located at the first side 733 or is arranged close to the first side 733, and the second point N is located on a connecting line of the first point M and the impeller center O, or at a position close to the connecting line of the first point M and the impeller center O.

Figure 14:
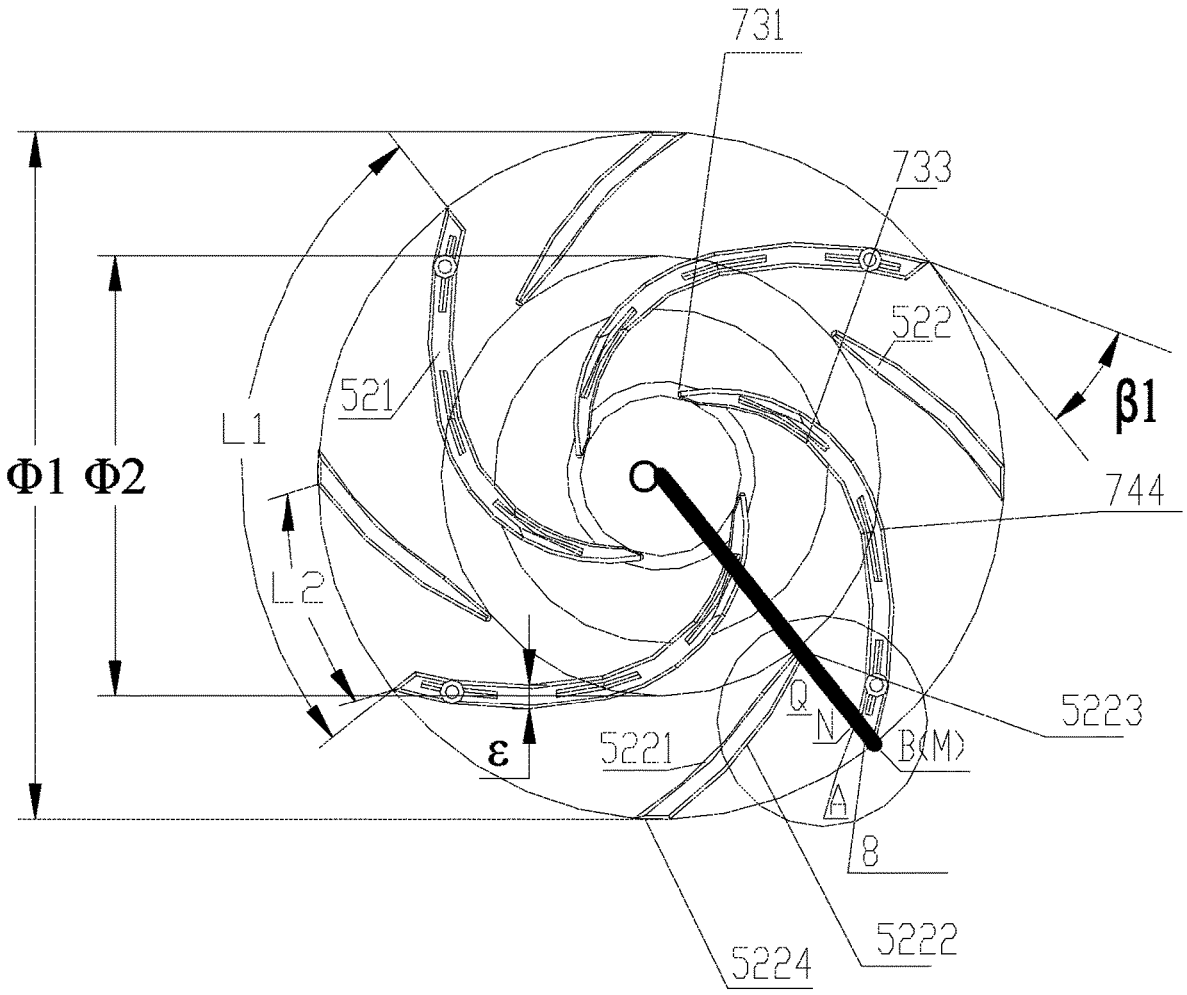
FIG. 14 is a schematic view showing the structure of an eighth embodiment of the first part of the rotor assembly in FIG. 3.
Figure 15:
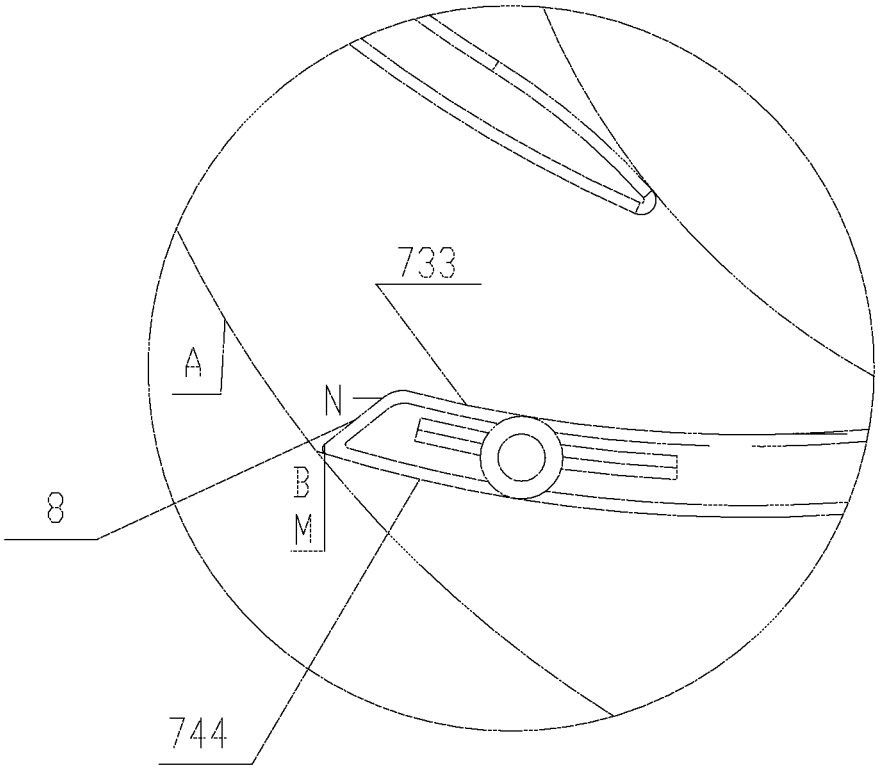
FIG. 15 is a schematic partially enlarged view showing the structure of a position Q of the first part in FIG. 14.

FIGS. 14 and 15 are schematic views of an eighth embodiment of the first part. The first blade 521 includes a first tail 8. The first tail 8 includes a first point M and a second point N. In the direction from the lower surface to the upper surface of the upper plate 51 along the axis of the impeller 5, an intersection of the extending line of the first side 733 with the outer edge of the upper plate 51 is a first intersection A, and an intersection of the extending line of the second side 744 or the second side 744 with the outer edge of the upper plate 51 is a second intersection B. The first point M is arranged to be substantially coincident with the second intersection B or is arranged relatively close to the second intersection B. A connecting line of the first point M and the impeller center O is defined as a borderline MO. The second point N is located at the first side 733 or the shortest distance of the second point N from the first side 733 or from the extending line of the first side 733 is less than ⅓ of the thickness ϵ of the first blade, and the second point N is located on the connecting line of the first point M and the impeller center O. Such a structure may facilitate the molding via a mould. The first tail 8 may be transited to the first side 733 by an arc, and the first tail 7 may also be transited to the second side 744 by an arc, which facilitates the molding via a mould.

Figure 16:
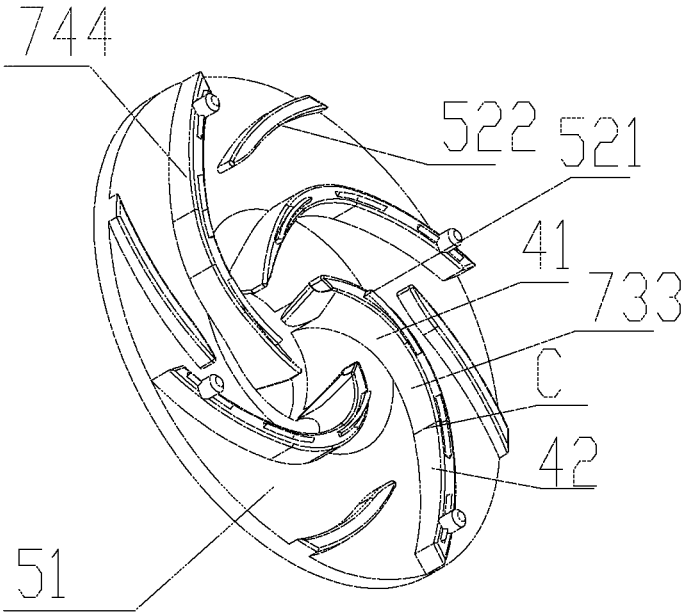
FIG. 16 is a schematic perspective view showing the structure of an embodiment of the first part of the rotor assembly in FIG. 3.

In the above description about the structure mentioned in the specification, the blade is fixedly connected to the lower surface of the upper plate, therefore, the structure of the first tail and the positioning relationship between the first point M and the second point N are all described in the direction from the lower surface to the upper surface of the upper plate along the axis of the impeller. Reference is made to FIG. 16, the blades include first blades 521 and second blades 522, and the first blades 521 and the second blades 522 are all shown as perspective structures. Each of the first blades 521 includes a first side 733 and a second side 744 and a first tail, each of the first side 733 and the second side 744 is a curved face, and the first tail is a plane, the connecting point C is a straight line, and the first arc 41 and the second arc 42 are virtually two curved faces which are arranged to be tangential to each other. The direction from the lower surface to the upper surface of the upper plate along the axis of the impeller may also refer to a projection of the first part on a plane perpendicular to the axis of the impeller, and those circumferences mentioned above are also defined circumferences supplemented for illustrating clear. In the above solutions, the blades may also be only the first blades, and may also have both the first blades and the second blades simultaneously.

It should be noted that, the above embodiments are only intended for describing the present application, and should not be interpreted as limitation to the technical solutions of the present application. Although the present application is described in detail in conjunction with the above embodiments, it should be understood by the skilled in the art that, modifications or equivalent substitutions may still be made to the present application by those skilled in the art; and any technical solutions and improvements of the present application without departing from the spirit and scope of the present invention also fall into the scope of the present application defined by the claims.

The invention claimed is:

1. An impeller, comprising an upper plate, blades, and a lower plate, wherein the blades are arranged between the upper plate and the lower plate, and the upper plate comprises an upper surface and a lower surface, and the blades are fixedly connected to the lower surface of the upper plate, the blades comprise first blades, at least one arc, or a combination of at least one arc and at least one plane, the first blades are uniformly distributed on the upper plate, each of the first blades comprises a first side, a second side, a first head and a first tail, the first head is closer to a center of the impeller than the first tail, the first side is concave, and the second side is convex, a first connecting portion is defined between the first tail and the first side, a second connecting portion is defined between the first tail and the second side, the second connecting portion is arranged closer to an outer edge of the upper plate than the first head or to be flush with the outer edge of the upper plate, the outer edge of the upper plate is defined as a first circumference, a diameter of the first circumference is defined as a first diameter, the first side has no intersection with the outer edge of the upper plate, a distance of the first connecting portion from the outer edge of the upper plate is greater than a distance of the second connecting portion from the outer edge of the upper plate, and an extending line of the second side is intersected with the outer edge of the upper plate or the second side is intersected with the outer edge of the upper plate, wherein in a direction from the lower surface to the upper surface of the upper plate along an axis of the impeller, an intersection of an extending line of the first side with the outer edge of the upper plate is defined as a first intersection, an intersection of the extending line of the second side with the outer edge of the upper plate or the second side with the outer edge of the upper plate is defined as a second intersection, the first side comprises a first arc and a second arc, the first arc is arranged closer to an center of the impeller than the second arc, the first arc and the second arc have different curvatures;

the first side comprises a connecting point or a connecting segment; the first arc and the second arc are connected and tangential to each other at the connecting point, or are connected and tangential to each other at the connecting segment;

the first tail comprises a first point and a second point, the first point is located on an arc, between the first intersection and the second intersection, of the first circumference, or is arranged toward the arc, between the first intersection and the second intersection, of the first circumference, and the first point is not coincident with the first intersection; a first borderline is defined, the first borderline is part of a tangency which is made at the first point to the first circumference, and the first point is connected to the connecting point to define a second borderline, or the first point is connected to a connection point between the connecting segment and the second arc to define the second borderline, and the second point is located between the first borderline and the second borderline, and an included angle between the first borderline and the second borderline is greater than 90 degree, wherein the first tail comprises an inclined portion, in the direction from the lower surface to the upper surface of the upper plate along the axis of the impeller, the inclined portion comprises the first point and the second point, and a connecting line of the first point and the second point is located between the first borderline and the second borderline, wherein the blades further comprise second blades, and each of the second blades comprises at least one arc, the second blades are distributed uniformly along the circumference of the upper plate, the number of the first blades is same as the number of the second blades, and the first blades and the second blades are arranged alternatively at intervals along a circumferential direction of the upper plate, each of the second blades comprises a second head and a second tail, the second head is arranged closer to the center of the impeller than the second tail, the distance of the second head from the center of the impeller ranges from 0.3 to 0.35 times of the first diameter.

2. The impeller according to claim 1, wherein a third circumference is defined, the connecting point is located on the third circumference, and the third circumference is arranged concentric with the first circumference, a diameter of the third circumference is a third diameter, and a ratio of the third diameter to the first diameter ranges from 0.5 to 0.8.

3. The impeller according to claim 1, wherein the upper plate encloses to define an inlet circumference of the impeller, the diameter of the inlet circumference is defined as an inlet diameter, and a tangency to the inlet circumference, at a side close to the first side of the first blade, is made at the first point to define a second borderline, the second point is located between the first borderline and the second borderline, an included angle between the first borderline and the second borderline is greater than 90 degree.

4. The impeller according to claim 1, wherein a fourth circumference is defined, and the fourth circumference is concentric with the first circumference, the diameter of the fourth circumference is defined as a fourth diameter, and the fourth diameter is one half of the first diameter, and the first borderline which is tangent to the fourth circumference, at a side away from the first side of the first blade, is made at the first point, the upper plate encloses to define an inlet circumference of the impeller, the diameter of the inlet circumference is defined as an inlet diameter, and a second borderline is defined, and the second borderline which is tangent to the inlet circumference, at a side close to the first side of the first blade, is made at the first point, the first tangency is the first borderline, and the second tangency is a second borderline, and the second point is located between the first borderline and the second borderline.

5. The impeller according to claim 1, wherein the upper plate encloses to define an inlet circumference of the impeller, the diameter of the inlet circumference is defined as an inlet diameter, a fifth circumference is defined, and the fifth circumference is arranged concentric with the first circumference, the diameter of the fifth circumference is defined as a fifth diameter, and the fifth diameter is one half of the inlet diameter, and an extending line of a connecting line of the first point and the second point intersects with the fifth circumference.

6. The impeller according to claim 5, wherein the center of the impeller is located on the extending line of the connecting line of the first point and the second point.

7. The impeller according to claim 1, wherein the distance of the first point from the second intersection is less than the distance of the first point from the first intersection.

8. The impeller according to claim 7, wherein a transition is provided between the first tail and the first side, and a transition structure is provided between the first tail and the second side.

9. The impeller according to claim 7, wherein the first tail comprises an inclined portion, in the direction from the lower surface to the upper surface of the upper plate along the axis of the impeller, the inclined portion comprises the first point and the second point, and a connecting line of the first point and the second point is located between the first borderline and the second borderline.

10. The impeller according to claim 1, wherein on the first circumference, an arc between second sides of adjacent first blades or an arc between extending lines of second sides of adjacent first blades is a first arc, and the arc length of the first arc is a first arc length; each of the second blades comprises a third side and a fourth side, the third side is concave and the fourth side is convex;

on the first circumference, an arc between, an intersection of the second side of the first blade with the first circumference or an extending line of the second side of the first blade with the first circumference, and, an intersection of the fourth side of a second blade close to the first side of the first blade with the first circumference or an extending line of the fourth side of the second blade close to the first side of the first blade with the first circumference, is a second arc, the arc length of the second arc is a second arc length, and the second arc length is 0.35 to 0.45 times of the first arc length.

11. A centrifugal pump, comprising an impeller, wherein the impeller comprises the impeller according to claim 1.

12. An electronic pump, comprising a shaft, a rotor assembly and a stator assembly, wherein the rotor assembly comprises an impeller and a rotor, the rotor comprises a permanent magnet, the impeller comprises:

an upper plate, blades, and a lower plate, wherein the blades are arranged between the upper plate and lower plate, and the upper plate comprises an upper surface and a lower surface, and the blades are fixedly connected to the lower surface of the upper plate, the blades comprise first blades, at least one arc, or a combination of at least one arc and at least one plane, the first blades are uniformly distributed on the upper plate, each of the first blades comprises a first side, a second side, a first head and a first tail, the first head is closer to a center of the impeller than the first tail, the first side is concave, and the second side is convex, a first connecting portion is defined between the first tail and the first side, a second connecting portion is defined between the first tail and the second side, the second connecting portion is arranged closer to an outer edge of the upper plate than the first head or to be flush with the outer edge of the upper plate, the outer edge of the upper plate is defined as a first circumference, a diameter of the first circumference is defined as a first diameter, the first side has no intersection with the outer edge of the upper plate, a distance of the first connecting portion from the outer edge of the upper plate is greater than the distance of the second connecting portion from the outer edge of the upper plate, and an extending line of the second side is intersected with the outer edge of the upper plate or the second side is intersected with the outer edge of the upper plate, in the direction from the lower surface to the upper surface of the upper plate along an axis of the impeller, an intersection of an extending line of the first side with the outer edge of the upper plate is defined as a first intersection, an intersection of the extending line of the second side with the outer edge of the upper plate or the second side with the outer edge of the upper plate is defined as a second intersection, the first side comprises a first arc close to an center of the impeller and a second arc away from the center of the impeller, the first arc and the second arc have different curvatures;

the first side comprises a connecting point or a connecting segment; the first arc and the second arc are connected and tangential to each other at the connecting point, or are connected and tangential to each other at the connecting segment;

the first tail comprises a first point and a second point, the first point is located on an arc, between the first intersection and the second intersection, of the first circumference, or is arranged toward the arc, between the first intersection and the second intersection, of the first circumference, and the first point is not coincident with the first intersection; a first borderline is defined, and the first borderline is part of a tangency which is made at the first point to the first circumference, and the first point is connected to the connecting point to define a second borderline, or the first point is connected to a connection point between the connecting segment and the second arc to define the second borderline, and the second point is located between the first borderline and the second borderline, and an included angle between the first borderline and the second borderline is greater than 90 degree, wherein the first tail comprises an inclined portion, in the direction from the lower surface to the upper surface of the upper plate along the axis of the impeller, the inclined portion comprises the first point and the second point, and a connecting line of the first point and the second point is located between the first borderline and the second borderline, wherein the blades further comprise second blades, and each of the second blades comprises at least one arc, the second blades are distributed uniformly along the circumference of the upper plate, the number of the first blades is same as the number of the second blades, and the first blades and the second blades are arranged alternatively at intervals along a circumferential direction of the upper plate, each of the second blades comprises a second head and a second tail, the second head is arranged closer to the center of the impeller than the second tail, the distance of the second head from the center of the impeller ranges from 0.3 to 0.35 times of the first diameter.

13. The electronic pump according to claim 12, wherein a third circumference is defined, and the connecting point is located on the third circumference, and the third circumference is arranged concentric with the first circumference, the diameter of the third circumference is a third diameter, and the ratio of the third diameter to the first diameter ranges from 0.5 to 0.8.

14. The electronic pump according to claim 12, wherein the upper plate encloses to define an inlet circumference of the impeller, the diameter of the inlet circumference is defined as an inlet diameter, and a tangency to the inlet circumference, at a side close to the first side of the first blade, is made at the first point to define a second borderline, the second point is located between the first borderline and the second borderline, an included angle between the first borderline and the second borderline is greater than 90 degree.

15. The electronic pump according to claim 12, wherein a fourth circumference is defined, and the fourth circumference is concentric with the first circumference, the diameter of the fourth circumference is defined as a fourth diameter, and the fourth diameter is one half of the first diameter, and the first borderline which is tangent to the fourth circumference, at a side away from the first side of the first blade, is made at the first point, the upper plate encloses to define an inlet circumference of the impeller, the diameter of the inlet circumference is defined as an inlet diameter, and a second borderline is defined, and the second borderline which is tangent to the inlet circumference, at a side close to the first side of the first blade, is made at the first point, the first tangency is the first borderline, and the second tangency is a second borderline, and the second point is located between the first borderline and the second borderline.

16. The electronic pump according to claim 12, wherein the upper plate encloses to define an inlet circumference of the impeller, the diameter of the inlet circumference is defined as an inlet diameter, a fifth circumference is defined, and the fifth circumference is arranged concentric with the first circumference, and the diameter of the fifth circumference is defined as a fifth diameter, and the fifth diameter is one half of the inlet diameter, and an extending line of a connecting line of the first point and the second point intersects with the fifth circumference.

* * * * *